US006630057B2

(12) United States Patent
Broom et al.

(10) Patent No.: US 6,630,057 B2
(45) Date of Patent: Oct. 7, 2003

(54) VACUUM BELT CONVEYOR

(75) Inventors: Allen Broom, Coquitlam (CA); Hannu Esa, Vantaa (FI)

(73) Assignee: Voith Paper Patent GmbH, Heidenheim (DE)

( * ) Notice: Subject to any disclaimer, the term of this patent is extended or adjusted under 35 U.S.C. 154(b) by 126 days.

(21) Appl. No.: 09/792,597

(22) Filed: Feb. 23, 2001

(65) Prior Publication Data

US 2001/0050154 A1 Dec. 13, 2001

(30) Foreign Application Priority Data

Feb. 26, 2000 (DE) ..... 100 09 188
Jul. 25, 2000 (DE) ..... 200 12 843

(51) Int. Cl.[7] ..... B65H 20/00
(52) U.S. Cl. ..... 162/363; 162/193; 226/95
(58) Field of Search ..... 162/193, 194, 162/255, 283, 286, 363, 364, 367, 369, 370, 374, 306; 226/91, 92, 97.1, 97.2, 97.3, 97.4, 95, 170–172, 189; 34/114, 117, 120, 623, 629, 635, 640, 641, 643, 644; 242/615.11, 615.12; 198/471.1, 803.5, 811; 83/155.1, 98–100; 271/194–197

(56) References Cited

U.S. PATENT DOCUMENTS 3,355,349 A * 11/1967 Devlin ..... 162/286
3,425,610 A * 2/1969 Stewart ..... 226/95
3,679,112 A * 7/1972 Black et al. ..... 226/3
3,741,116 A * 6/1973 Green et al. ..... 101/287
3,756,912 A * 9/1973 Rooney ..... 162/255
4,022,366 A 5/1977 Rooney ..... 226/91
4,294,540 A * 10/1981 Thettu ..... 355/76
4,481,066 A * 11/1984 Hirakawa et al. ..... 156/472
4,660,752 A * 4/1987 Rikard et al. ..... 226/95
4,692,215 A 9/1987 Kerttula ..... 162/289
5,792,318 A * 8/1998 Mancini ..... 162/193
5,893,505 A * 4/1999 Mueller ..... 226/97.3
6,290,817 B1 * 9/2001 Autio ..... 162/289

FOREIGN PATENT DOCUMENTS

DE 1 257 516 7/1968 ..... B65H/47/00
DE 90 13 654.3 2/1991 ..... B26D/7/01
DE 196 47 919 A1 5/1998 ..... B65H/20/12
DE 200 01 082 U1 6/2000 ..... B65H/23/02
EP 0 254 666 A1 1/1988 ..... D21G/9/00
EP 0 728 693 A2 8/1996 ..... B65H/20/00

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

A vacuum belt conveyor is suitable for guiding a running paper web, in particular a threading tail, and includes an air-pervious endless conveyor belt traveling around a vacuum box which supports two belt pulleys. At least one vacuum blower creates a negative pressure within the loop of the belt. The vacuum blower is positioned within the vacuum box at a certain distance from the conveying run of the belt and is driven by an air turbine. One of the pulleys is driven by an electric motor (M') positioned inside of that pulley.

24 Claims, 4 Drawing Sheets

VACUUM BELT CONVEYOR

BACKGROUND OF THE INVENTION

1. Field of the Invention

The invention relates to a vacuum belt conveyor.

2. Description of the Related Art

Vacuum belt conveyors are used to facilitate the threading of a paper web into a machine for the production, finishing or processing of a paper web. When a papermaking machine is started (or restarted after a web break) a narrow "tail" or lead-in strip is cut from the running web. This tail is transferred by means of the vacuum belt conveyor, e.g., from the end of a machine section to the infeed area of a following machine section.

In U.S. Pat. No. 3,355,349, a vacuum belt conveyor is disclosed having a vacuum box within the loop of the conveyor belt. The conveying run of the belt is traveling directly across the open surface (e.g., across a cover plate comprising suction openings) of the vacuum box, so that the negative pressure propagates through the conveying run of the belt in order to draw a web or a tail to be guided by the conveyor belt by suction. A side wall of the vacuum box is connected via a vacuum pipe to a vacuum source which is usually positioned at a certain distance from the vacuum belt conveyor. In many cases it is necessary to mount the vacuum belt conveyor pivotably to a stand or frame so that the conveyor can be moved to a non-functional position and back to a functional position where it is ready to perform a further threading operation. For that reason the vacuum pipe (which must be rather voluminous) must be designed as a flexible hose. This flexible hose is generally a disturbing factor.

In U.S. Pat. No. 4,692,215, a vacuum belt conveyor is disclosed which tries to avoid a vacuum box, an external vacuum source and a vacuum pipe therebetween. Arranged within the loop of the conveyor belt, in close proximity to the inner side of the conveying run, are so-called pneumatic guide plates or "air trays". Air jets are directed over the guide plates in the direction of belt travel so that a negative pressure is created in order to draw a web or a tail to be guided on the conveyor belt by suction. Means are provided to adjust the overall pressure distribution in the traveling direction of the conveying run of the conveyor belt. However, there is a danger that the negative pressure fluctuates along the belt travel direction depending on the positioning of the guide plates. The resulting vacuum pulsation can cause problems in the threading operation, especially if the conveyor is inverted. In this case the web or tail may fall off the conveyor, especially if an overpressure is produced to detach the web or tail from the downstream end of the conveying run of the belt as disclosed in FIGS. 5A and 5B of US '215. Even in the normal position of the conveyor (conveying belt run on top side), there is a danger that the pneumatic guide plates produce a too high over-pressure at the downstream end of the conveyor so that the web or tail jumps off in an uncontrollable manner. Possibly, this disadvantage results from the fact that the guide plates do not have positive means for the discharge of the air.

The known conveyor (US '215) also requires that the pneumatic guide plates be put in contact with the inner side of the belt in order to get the required level of vacuum. This makes it more prone to plugging and other problems associated with paper being sucked into the conveyor.

SUMMARY OF THE INVENTION

The present invention provides an improved vacuum belt conveyor which avoids a flexible pipe connection from the belt conveyor to an external vacuum source while, nevertheless, the vacuum belt conveyor, if needed, remains movable between various positions.

The invention at least minimizes the length of a pipe connection from a vacuum belt conveyor to its vacuum source or avoids the pipe connection completely.

The present invention provides an improved vacuum belt conveyor wherein the level of the negative pressure is as stable (or continuous) as possible along the travel path of the conveying run of the belt, in order to obtain an optimized threading operation.

The invention provides the option that any over-pressure or backpressure is avoided at the downstream end of the conveyor.

Also, the invention provides an improved belt conveyor which avoids plugging or sucking paper into the interior of the conveyor.

The aforementioned features as well as further features that will be described herinafter are attained—according to a first embodiment of the invention—by a novel position of a vacuum blower, namely within the loop of the air-pervious endless belt. The vacuum blower can be positioned within the loop of the belt in such a way that the inflow of the blower is arranged in close proximity to the inside of the conveying run of the belt. In this case, the at least one vacuum blower is arranged in the place of the formerly provided vacuum box. However, in a second embodiment, the vacuum belt conveyor includes a vacuum box, and the at least one vacuum blower is positioned inside the vacuum box near the return run of the belt, with the inflow of the blower being open towards the open surface (e.g., to a cover plate having suction openings) of the vacuum box. There may be provided a certain distance between the blower's inflow and the open surface.

The second embodiment also allows retrofiting an existing vacuum belt conveyor by installing a vacuum blower inside a conventional vacuum box.

It should be understood that a vacuum blower of very compact design can be used, the space inside the belt loop being relatively small. The vacuum blower is driven by an air turbine. The benefit of such an air turbine is that it has a very small overall height (measured along the rotational axis). This is an important advantage for the positioning of the vacuum blower within the loop of the belt.

If needed, the vacuum blower (being positioned inside the belt loop) may be driven by an electric motor, which again can have a very small overall height. The vacuum belt conveyor can be supported by a rotatable or pivotable support, so that the complete vacuum belt conveyor including the vacuum blower can be moved, e.g., from a functional position to a non-functional position and back to the functional position.

According to the invention, at least one air turbine driven vacuum blower developed by MISCEL OY, LTD., Tampere-Finland can be used.

According to a second embodiment of the invention, the features mentioned above are attained by creating the negative pressure (required in the belt loop) by use of an air stream induced by a propulsion jet, with the air stream and the propulsion jet being joined to a "combined flow" which is positively directed to the outside of the belt conveyor.

The various embodiments of the invention have in common that the following further advantages are attained;

The necessity of providing an external voluminous vacuum pipe is eliminated, because the vacuum source (vacuum blower or propulsion jet device) is positioned inside of the conveyor, namely inside of the belt loop. However, at the same time, the discharge of the air emitted by the vacuum blower (and by the air turbine if existing) or by a propulsion jet device can be reliably controlled, so that the emitted air does not disturb the travel of the paper web or threading tail. Also, the airflow produced by the blower and/or the air turbine or produced by the propulsion jet keeps the vacuum belt conveyor much cleaner than with previous known conveyor designs, in particular if the discharge air is directed through the return run of the belt.

By use of the invention, further advantages are obtained, namely improved accessibility to the vacuum components, e.g., for maintenance and service. Also, a constant vacuum level along the conveying run of the belt is achieved. Furthermore, at the downstream end of the conveying run of the belt, the web or tail can be detached from the belt by an airjet which flows through the air-pervious belt in a conventional manner or, even more reliably, by a nose shoe designed according to U.S. Pat. No. 4,022,366. That nose shoe avoids the need of any backpressure in the interior of the belt loop.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
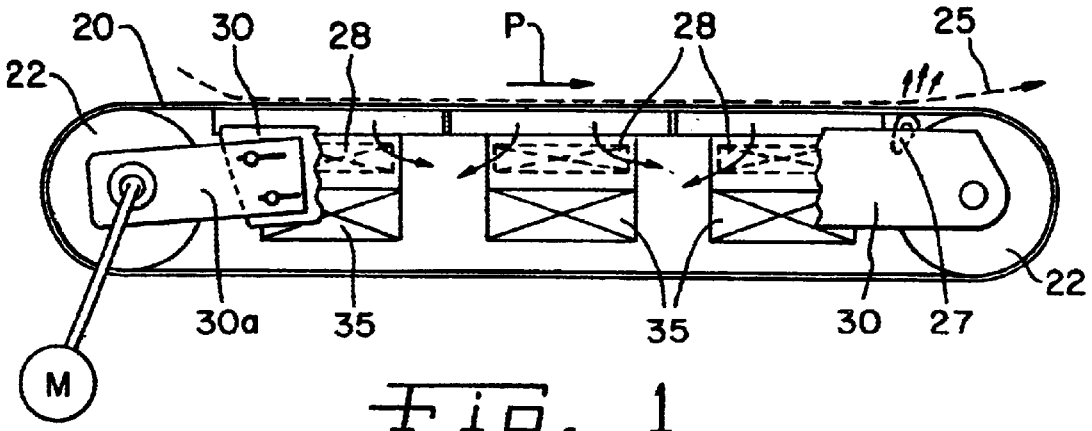
FIG. 1 is a schematic view of a first embodiment of the invention with air turbine driven vacuum blowers arranged within the loop of the belt.

The vacuum belt conveyor shown in FIG. 1 is used to guide a running web, in particular a threading tail 25. Such a tail is, as known, a relatively narrow part (e.g., 0.2–0.3 m wide) of a running web, e.g., of a paper or board web, and is used for the "threading" of the web, e.g., inside a papermaking machine.

The conveyor includes an air-pervious, endless conveyor belt 20, which runs over two pulleys 22. The two pulleys 22 are rotatably mounted in a frame 30, 30*a*. One of the pulleys 22 is provided with a drive M, which is shown only schematically in FIG. 1. Element 30*a* may serve for tensioning the belt 20.

The conveying run of the air-pervious conveyor belt 20 running in the direction of web travel (see arrow P) is in the present case the upper run; an opposite arrangement is also possible. The conveying run is traveling over the suction inlet of, e.g., three vacuum blowers 28. Due to this, web 25 is sucked onto the conveyor belt 20 and transported. For further guiding of web 25, an air blow nozzle 27 or other elements can be provided at the downstream end of the conveyor.

Each of the (e.g., three) vacuum blowers 28 is driven by an air turbine 35. Instead of a conventional vacuum box, frame 30, 30*a* supports the pulleys 22 as well as the turbine driven blowers 28 which are positioned completely within the loop of belt 20. Each blower 28 is arranged in such a way that its suction inlet is in close proximity to the inside of the conveying run of belt 20. The inlet side of the blowers 28 may be covered by a cover plate (not shown) having suction slots or similar openings. Outlet channels (not shown) may be connected to the blowers 28 and/or to the air turbines 35 in order to emit the air sideways out of the belt loop. Alternatively, the emitted air may flow through the return run of belt 20.

Figure 2:
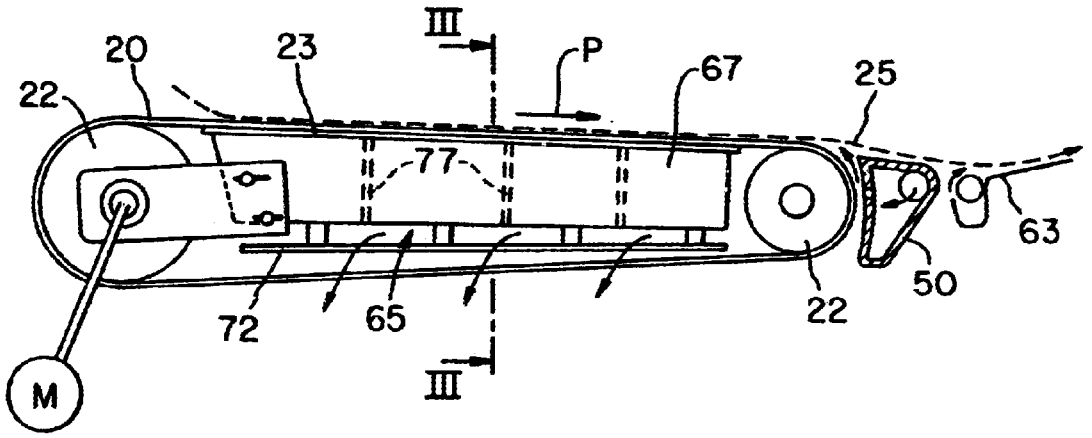
FIG. 2 is a schematic view of another type of vacuum belt conveyor creating the negative pressure by use of a propulsion jet.

The vacuum belt conveyor shown in FIGS. 2 and 3 includes again an air-pervious endless conveyor belt 20 traveling around two pulleys 22, a vacuum source 65 positioned inside the belt loop as well as a nose shoe 50 and a guiding tray 63 disposed beyond the downstream end of the belt conveyor. The vacuum source 65 includes two blow boxes 66 and 67 which extend in the direction of belt travel. Blow boxes 66, 67 are arranged side by side (as seen in the cross-section, shown in FIG. 3) directly below a cover plate 23 provided with slots or similar openings and being in contact with the inner side of the conveying run of the belt 20. Seen again in the cross-section (FIG. 3), each blow box 66, 67 has a wall 68 positioned in close proximity to the cover plate 23 and divergent therefrom. A second wall 69 of each blow box includes a rounded edge which forms together with the free end of the first mentioned wall 68 a nozzle orifice 70. Each blow box 66, 67 is connected to a source 71 of pressurized air so that the nozzle orifice 70 produces a propulsion jet which, due to the Coanda-effect, adheres to second wall 69. The propulsion jet induces a secondary air stream passing through the air-pervious belt 20 and through the openings of cover plate 23, thereby creating a negative pressure at the belt 20 and causing the web or tail 25 to cling to the belt 20. The combined flow of propulsion jet and secondary air is initially directed towards the return run of the belt 20. Therefore, close to the return run of the belt 20, a guide plate 72 may be provided to direct the combined flow sideways out of the belt loop. Alternatively the combined flow may go through the return run of belt 20.

Figure 3:
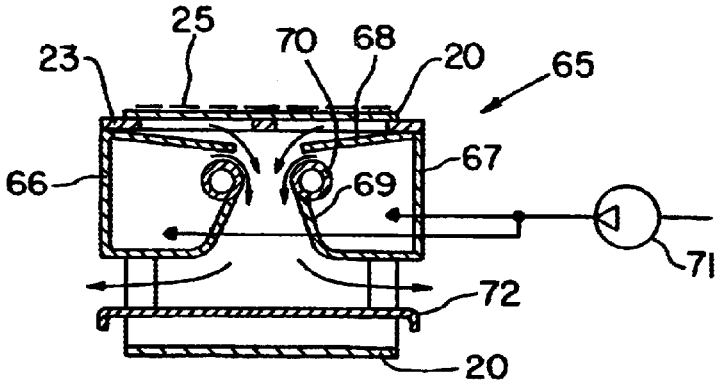
FIG. 3 is a sectional view along line III—III of FIG. 2.

According to FIG. 3, the propulsion jets are flowing towards the middle of the conveyor when passing the nozzle orifices 70. However, at least two blow boxes of the type shown in FIG. 3 may also be arranged in such a way that the two or more propulsion jets are flowing in a direction from the middle of the conveyor towards the outside.

According to FIG. 4, only one blow box 75 is provided below the cover plate 23. The wall of the blow box which is positioned in close proximity to the cover plate 23 has a plurality of outlets 76, in order to produce propulsion jets. These again induce secondary air streams in order to create the negative pressure required at the belt 20.

Figure 4:
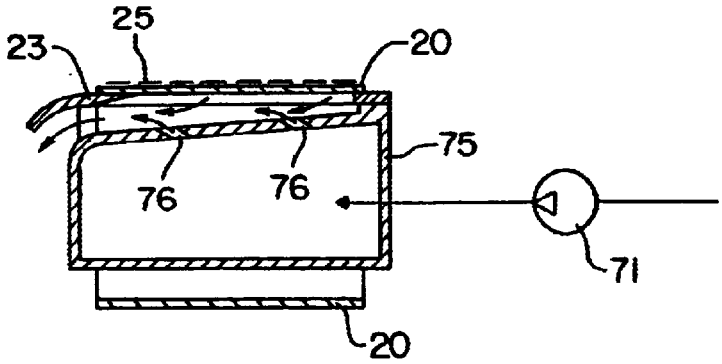
FIG. 4 is a modification of FIG. 3.

It should be noted that according to FIGS. 3 and 4, the propulsion jets are initially emitted in a direction which is across the belt travel direction. Preferably, the propulsion jets are air jets. However, liquid jets or jets of a liquid-air-mixture may also be used. Each of the blow boxes 66, 67 or 75 may be subdivided by partition walls 77, thusly forming a number of different blow box sections to allow sectional vacuum variation by individually adjusting the air pressure of the air flows which produce the propulsion jets. Possibly, in a zone of belt 20 where less or no negative pressure is required, a blow box section may be eliminated.

Figure 5:
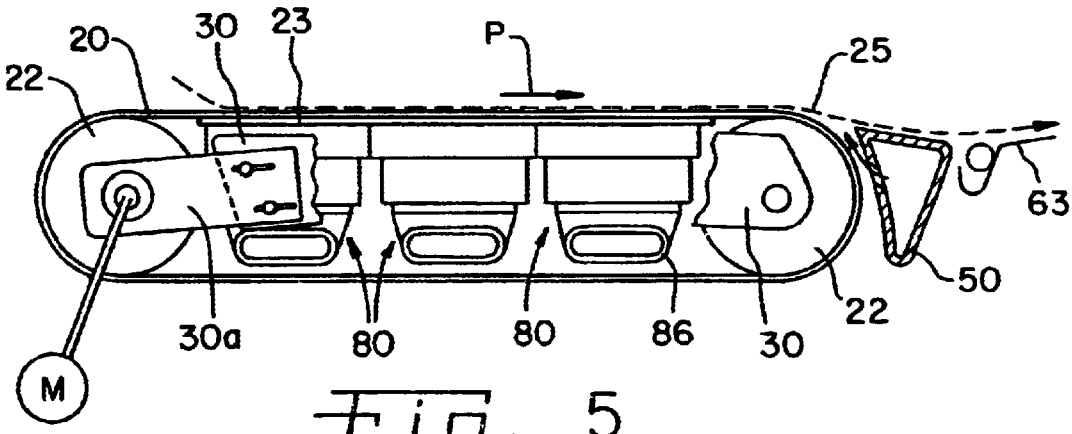
FIG. 5 is a schematic view of a vacuum belt conveyor with so-called air amplifiers.
Figure 6:
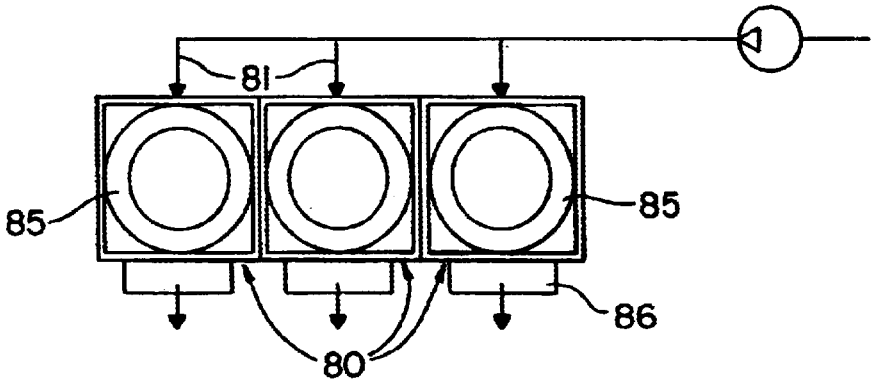
FIG. 6 is a view from above onto the air amplifiers of FIG. 5.
Figure 7:
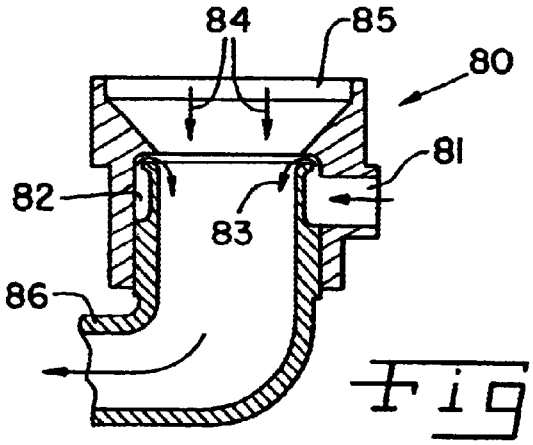
FIG. 7 is an enlarged sectional view through an air amplifier.

In the vacuum belt conveyor shown in FIGS. 5 to 7, a row of so-called air amplifiers 80 is arranged inside the belt loop, directly below a cover plate 23. The air amplifiers 80 may be connected to a frame 30 which also supports the pulleys 22. Alternatively, a number of air amplifiers 80 may be mounted inside a conventional vacuum box. Air amplifiers manufactured by EXAIR Corporation, Cincinnati, Ohio, USA may be used. Each air amplifier 80 has an inlet 81 for the supply of compressed air which flows into an anular chamber 82 and from there through a ring nozzle whereby an anular propulsion jet 83 is produced. This propulsion jet again induces a secondary air stream 84 flowing through a suction inlet 85 which may be arranged in close proximity to—or at a certain distance from the covering plate 23, thus creating the vacuum required at the conveying run of the belt 20. Each air amplifier 80 also has an outlet 86 for the combined flow of propulsion jet and secondary air. Outlet 86 may have the form of an elbow pipe directed sideways out of the loop of the belt 20. Alternatively a number of conventional air amplifiers having a straight outlet pipe may be arranged in a vacuum box, with the axes of the air amplifiers being arranged perpendicular to the side walls of the vacuum box. In other words, the exhaust airstreams are flowing straight out and at least partly through the return run of belt 20.

Figure 8:
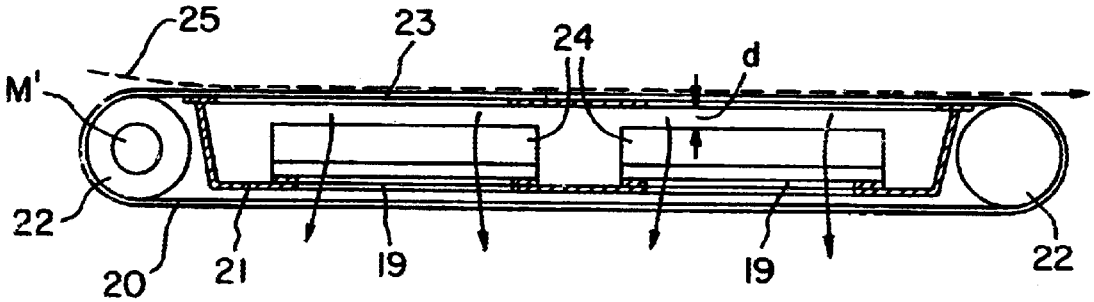
FIG. 8 is a longitudinal sectional view of a further vacuum belt conveyor including a more compact vacuum blower positioned in a vacuum box.
Figure 9:
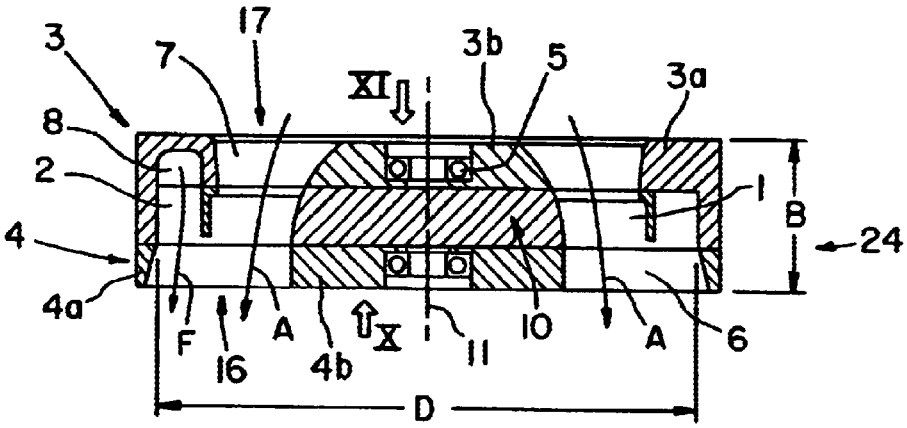
FIG. 9 is a sectional view through the compact vacuum blower of FIG. 8.
Figure 10:
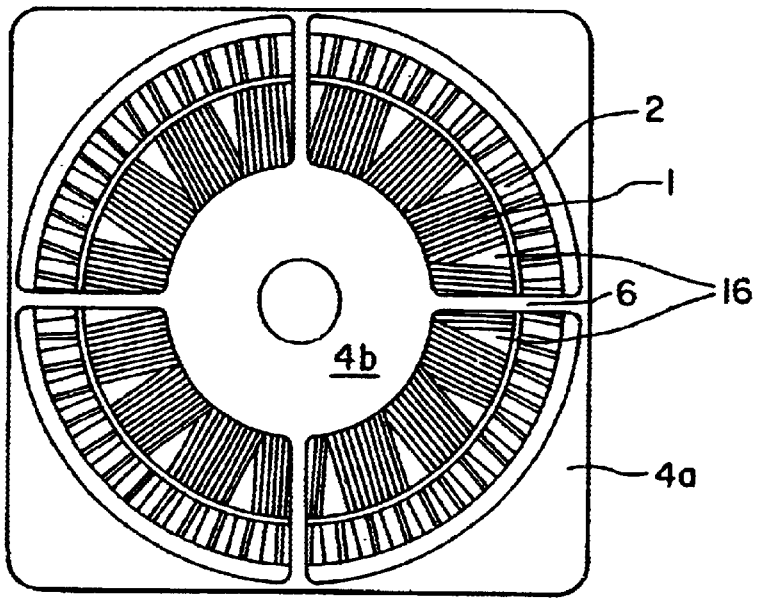
FIG. 10 is a view along arrow X of FIG. 9.
Figure 11:
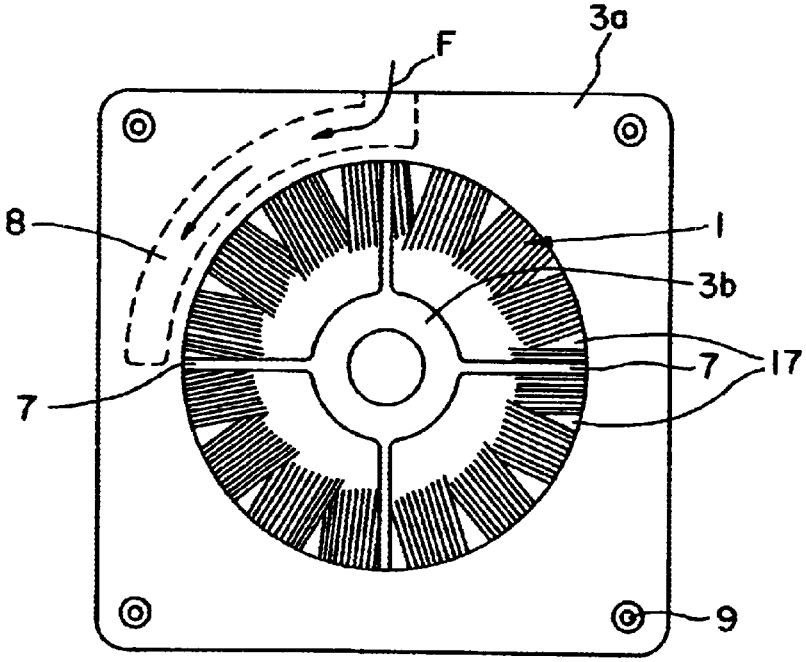
FIG. 11 is a view along arrow XI of FIG. 9.

The vacuum belt conveyor shown in FIG. 8 differs from that of FIG. 1 in that inside the loop of belt 20 a vacuum box 21 is provided having a cover plate 23 which has openings (e.g., slots) and which contacts the conveying run of belt 20. The pulleys 22 (supported by vacuum box 21) have a relatively small diameter (compared with FIG. 1). Therefore, also the height of the vacuum box 21 is relatively small. Nevertheless, at least one air turbine driven vacuum blower 24 is positioned inside the vacuum box 21. This is possible due to a very compact blower design described below with the aid of FIGS. 9–11. There is a certain distance d between the inner surface of cover plate 23 and the suction inlet of the blower(s) 24. This results in a significant advantage of the belt conveyor, namely in a relatively uniform negative pressure along the travel path of the conveying run of belt 20. The outlet side of blower 24 is close to the bottom of vacuum box 21 (having exhaust openings 19) and therefore near to the belt's return run. The emitted air flows through the belt's return run, so that the belt is kept clean.

According to FIG. 8, one of the pulleys 22 is driven by a motor M' which is located in the interior of this pulley 22. Therefore, in summary, one of the remarkable features of the vacuum belt conveyor shown in FIG. 8 is its very compact design because both the vacuum source 24 and the drive motor M' are located in the interior of the apparatus. The air turbine driven vacuum blower 24 shown in FIGS. 9–11 has an extremely small overall length B (measured along the rotational axis 11). The overall length B is less than one-third of the outer diameter D of the impeller 10. The impeller 10 includes a rim of blower vanes 1 which produce an air stream A. Impeller 10 also includes a rim of turbine vanes 2 which is used to drive the impeller 10. The rim of turbine vanes 2 is wrapped around the rim of blower vanes 1. The rotatable impeller 10 is supported by two anti-friction bearings 5. One of the bearings 5 is positioned in an inlet housing portion 3. The other bearing 5 is positioned in an outlet housing portion 4. The two housing portions 3, 4 are connected one to the other by screws 9.

The inlet housing portion 3 includes an outer inlet section 3*a* and a central inlet section 3*b*. The two sections 3*a* and 3*b* are connected one to the other by some (e.g., four) small webs 7. Thereby, large inlet channels 17 are formed in the inlet housing portion 3. The outlet housing portion 4 includes an outer section 4*a* and a central section 4*b* which are connected one to the other by some small webs 6. Thereby large outlet channels 16 are formed in the outlet housing portion 4. An inlet channel 8 for a pressurized fluid F (e.g., pressurized air, steam or water) is located within the outer inlet section 3*a* of housing portion 3. According to FIG. 9, channel 8 is open towards the rim of turbine vanes 2, but only towards a sector of that rim (according to FIG. 11 about 25% of the total rim 2). The pressurized fluid F flows through the rim of turbine vanes 2 in a substantially axial direction, thereby producing the required rotation of the impeller 10. The rotating impeller 10 draws in air through the air inlet channels 17. In this way, an air stream A is produced which is exhausted through the outlet channels 16 in a substantially axial direction, and a negative pressure is produced in front of the inlet channels 17.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run, said loop having both a conveying run beginning and a conveying run end, said conveyor including at least one nozzle both adjacent said conveying run end and within said loop, at least one nozzle configured for blowing a gas through said belt at said conveying run end; and at least one vacuum blower disposed within said loop of said belt, said at least one vacuum blower being configured to establish a negative pressure within said loop at an inside of said conveying run of said belt.

2. The assembly of claim 1, wherein said at least one vacuum blower has an inflow disposed adjacent to the inside of said conveying run of said belt.

3. The assembly of claim 1, further comprising a vacuum box disposed within said loop of said belt and opening toward the inside of said conveying run of said belt, said at least one vacuum blower being disposed inside said vacuum box.

4. The assembly of claim 3, wherein said at least one vacuum blower has an inflow and is disposed adjacent to said return run of said belt, said vacuum box having a cover plate, said cover plate and said inflow of said at least one vacuum blower defining a gap therebetween.

5. The assembly of claim 1, further comprising a vacuum box having at least one exhaust opening opening toward said return run of said belt.

6. The assembly of claim 1, further comprising a driving air turbine, said at least one vacuum blower having an impeller connected to said driving air turbine.

7. The assembly of claim 6, further comprising a housing containing each of said impeller and said air turbine.

8. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run;

at least one vacuum blower disposed within said loop of said belt, said at least one vacuum blower being configured to establish a negative pressure within said loop at an inside of said conveying run of said belt;

a driving air turbine, said at least one vacuum blower having an impeller connected to said driving air turbine, said impeller including a rim of blower vanes configured for producing an air stream, said impeller also including a rim of turbine vanes configured for driving said impeller by use of a pressurized fluid, one of said rim of blower vanes and said rim of turbine vanes being wrapped around an other of said rim of blower vanes and said rim of turbine; and a housing containing each of said impeller and said air turbine.

9. The assembly of claim 8, wherein said rim of turbine vanes is wrapped around said rim of blower vanes.

10. The assembly of claim 8, wherein said blower vanes extend in a radial direction.

11. The assembly of claim 8, wherein said turbine vanes extend in a radial direction.

12. The assembly of claim 8, wherein said housing includes an inlet channel for the pressurized fluid, said inlet channel being open towards only a sector of said rim of turbine vanes.

13. The assembly of claim 8, wherein said impeller has an axis, the air stream and the pressurized fluid being exhausted substantially parallel to said axis of said impeller and through said return run of said belt.

14. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run;

at least one vacuum blower disposed within said loop of said belt, said at least one vacuum blower being configured to establish a negative pressure within said loop at an inside of said conveying run of said belt;

a driving air turbine, said at least one vacuum blower having an impeller connected to said driving air turbine, said impeller including a bearing, a housing including a disc-shaped inlet portion and a disc-shaped outlet portion, each of said inlet portion and said outlet portion supporting said bearing of said impeller; and said housing containing each of said impeller and said air turbine.

15. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run;

at least one vacuum blower disposed within said loop of said belt, said at least one vacuum blower being configured to establish a negative pressure within said loop at an inside of said conveying run of said belt;

a driving air turbine, said at least one vacuum blower having an impeller connected to said driving air turbine, said impeller including an axis and an outer diameter, said vacuum blower having a length along said axis of said impeller, said length of said vacuum blower being less than said outer diameter of said impeller; and a housing containing each of said impeller and said air turbine.

16. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run, said loop having both a conveying run beginning and a conveying run end, said conveyor including at least one nozzle both adjacent said conveying run end and within said loop, at least one nozzle configured for blowing a gas through said belt at said conveying run end;

a negative pressure element disposed within said loop of said belt, said at least one negative pressure element being configured to establish a negative pressure within said loop at an inside of said conveying run of said belt, said negative pressure element being configured for producing at least one propulsion jet of at least one of air and liquid such that said at least one propulsion jet induces an air stream creating the negative pressure; and a directing device configured for directing a combined flow of the at least one propulsion jet and the air stream to outside of said belt conveyor assembly.

17. The assembly of claim 16, further comprising:

a source of at least one of pressurized air and pressurized liquid having at least one nozzle orifice configured for producing said at least one propulsion jet; and at least one blow box disposed within said belt loop, said at least one blow box being connected to said source of at least one of pressurized air and pressurized liquid.

18. The assembly of claim 16, wherein said negative pressure element comprises at least one air amplifier configured for creating a required negative pressure within said belt loop.

19. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run;

a negative pressure element disposed within said loop of said belt, said at least one negative pressure element being configured to establish a negative pressure within said loop at an inside of said conveying run of said belt, said negative pressure element being configured for producing at least one propulsion jet of at least one of air and liquid such that said at least one propulsion jet induces an air stream creating the negative pressure;

a directing device configured for directing a combined flow of the at least one propulsion jet and the air stream to outside of said belt conveyor assembly a source of at least one of pressurized air and pressurized liquid having at least one nozzle orifice configured for producing said at least one propulsion jet; and at least one blow box disposed within said belt loop, said at least one blow box being connected to said source of at least one of pressurized air and pressurized liquid, said at least one blow box extends in a direction of belt travel, the at least one propulsion jet flowing transverse to the direction of belt travel.

20. The assembly of claim 19, wherein said at least one blow box comprises two blow boxes arranged side by side in a direction transverse to the direction of belt travel.

21. The assembly of claim 20, wherein said at least one nozzle orifice comprises a plurality of nozzle orifices, said at least one propulsion jet comprising a plurality of propulsion jets flowing in at least two directions toward a middle portion of said belt conveyor assembly adjacent to said nozzle orifices, each said blow box having a rounded edge configured for deviating said propulsion jets toward said return run of said belt.

22. The assembly of claim 21, further comprising a guide element configured for directing a combined flow of the propulsion jet and air out of said belt loop in a direction substantially perpendicular to the direction of belt travel.

23. The assembly of claim 21, wherein said propulsion jets flow from said middle portion of said belt conveyor assembly to outside of said belt conveyor assembly.

24. A vacuum belt conveyor assembly for guiding a threading tail of a moving fiber material web, said assembly comprising:

at least two pulleys;

a substantially air-pervious endless conveyor belt carried by said at least two pulleys, said belt forming a loop including a conveying run and a return run;

a negative pressure element disposed within said loop of said belt, said at least one negative pressure element being configured to establish a negative pressure within said loop at an inside of said conveying run of said belt, said negative pressure element being configured for producing at least one propulsion jet of at least one of air and liquid such that said at least one propulsion jet induces an air stream creating the negative pressure;

a directing device configured for directing a combined flow of the at least one propulsion jet and the air stream to outside of said belt conveyor assembly; and an air-pervious plate contacting an inner side of said conveying run of said belt.

* * * * *